US005511317A

United States Patent [19]

Allen

[11] Patent Number: 5,511,317

[45] Date of Patent: Apr. 30, 1996

[54] AUTOMATIC SIGHTING DEVICE FOR A PROJECTILE LAUNCHER

[76] Inventor: Ivan C. Allen, 2894 Columbia Blvd., St, Helena, Oreg. 97051

[21] Appl. No.: 231,111

[22] Filed: Apr. 22, 1994

[51] Int. Cl.[6] ..... F41G 1/467

[52] U.S. Cl. ..... 33/265; 33/251; 124/87

[58] Field of Search ..... 33/265, 246, 251; 124/87

[56] References Cited

U.S. PATENT DOCUMENTS

| | | | |
|---|---|---|---|
| 2,669,023 | 2/1954 | Pizzuti . | |
| 3,431,652 | 3/1969 | Leatherwood | 33/246 |
| 3,487,548 | 1/1970 | Frydenlund . | |
| 3,521,362 | 7/1970 | Duplechin . | |
| 3,666,368 | 5/1972 | Sprandel | 33/265 |
| 3,875,674 | 4/1975 | Davidson | 33/265 |
| 3,910,700 | 10/1975 | Sprandel | 33/265 |
| 4,109,390 | 8/1978 | Smith et al. | 33/265 |
| 4,224,741 | 9/1980 | Perry . | |
| 4,473,959 | 10/1984 | Saltzman . | |
| 4,541,179 | 9/1985 | Closson . | |
| 4,555,856 | 12/1985 | Brown . | |
| 4,570,352 | 2/1986 | Leal | 33/265 |
| 4,625,420 | 12/1986 | Figured . | |
| 4,669,196 | 6/1987 | Kersey | 33/265 |
| 4,726,123 | 2/1988 | Keller . | |
| 4,967,478 | 11/1990 | Sherman | 33/265 |
| 4,979,309 | 12/1990 | Oligschlaeger . | |
| 4,995,166 | 2/1991 | Knemeyer | 33/265 |
| 5,025,565 | 6/1991 | Stenerson et al. | 33/265 |
| 5,092,052 | 3/1992 | Godsey . | |
| 5,117,804 | 6/1992 | Jörlöv . | |

OTHER PUBLICATIONS

Bow Hunters Discount Warehouse, Inc., Summer Edition 1992, pp. cover page, 82–94.

*Primary Examiner*—Thomas B. Will

*Attorney, Agent, or Firm*—William A. Birdwell & Associates

[57] ABSTRACT

A sighting device for use with a projectile launcher having a sighting element that is adjustable in height and an adjustment mechanism for adjusting the sighting element's height to match substantially the height of a target as apparent at the sighting device in the line of sight to the target. The sighting device further comprises a targeting mechanism that, in response to the height adjustment, automatically displaces the position of the sighting element in a generally vertical plane so that maintenance of alignment of the target in the sighting element requires the user to adjust the elevation of the launcher and, consequently, the launch angle. In one embodiment, the sighting device comprises a pair of opposed rotatable disks, the disks having respective predetermined irregular peripheries. The sighting element comprises an aperture formed between selectable portions of the peripheries along the line of sight. The sighting element's height and vertical displacement are simultaneously adjusted by rotating the disks. In a second embodiment, the sighting element comprises a head having a predetermined irregular periphery. The head's height and vertical displacement are simultaneously adjusted by rotating the lever about the pivot.

22 Claims, 4 Drawing Sheets

AUTOMATIC SIGHTING DEVICE FOR A PROJECTILE LAUNCHER

BACKGROUND OF THE INVENTION

This invention relates to sighting devices for projectile launchers, particularly sighting devices using the apparent height of a target at the sighting device to sight the target and, in so doing, automatically aim the launcher to facilitate accurate delivery of projectiles at the target.

Sighting devices are widely used in conjunction with projectile launchers, such as target guns and archery bows. Use of sighting devices is generally desirable so as to facilitate accurate delivery of the launched projectile, e.g., bullets, pellets, arrows or the like, at a target located within a range of distances from the launcher. In archery, for example, sighting devices generally are desirable for use by an archer in properly selecting the angle at which the arrow is launched, that is, in aiming the bow. The selection of the launch angle is a difficult task in archery as it requires consideration of numerous factors, including the target's position, gravity, the arrow's launch velocity, and other environmental and launch conditions affecting the trajectory of the arrow in its flight from the bow to the target. Sighting devices are employed to account for one or more of such factors such that, when the archer aligns the target in a sighting element, e.g., cross-hairs or a pin, the sighting device sets the launch angle and, thereby, the trajectory. Sighting devices are similarly employed in using other projectile launchers.

Various sighting devices have been employed for use with archery bows. One type of sighting device relies on the archer determining the target's distance so as to adjust manually the sighting device for that distance or to select one of a plurality of sighting elements, such elements calibrated for respective distances. This type of sighting device, however, is subject to significant limitations. For example, the archer determines the distance either using guesswork or using a range-finder separate from the sighting device. The former approach introduces undesirable inaccuracy; the latter approach one or more undesirable additional steps. In addition, use of multiple pins not only requires determination of the target's distance, but generally also (i) requires the archer to calibrate the pins, that is, to fix their relative positions, through trial-and-error and (ii) limits the archer's accuracy to the respective distances associated with the finite number of pins. This type of sighting device can be found in Pizzuti U.S. Pat. No. 2,669,023, Frydenlund U.S. Pat. No. 3,487,548, Perry U.S. Pat. No. 4,224,741, Closson U.S. Pat. No. 4,541,179, Godsey U.S. Pat. No. 5,092,052 and Jörlöv U.S. Pat. No. 5,117,804.

Another type of sighting device incorporates a conventional optical range finder, e.g., a coincident image optical range-finder, together with a separate sighting element. The archer aligns the images in the range-finder and, in so doing, the sighting element is moved to the proper position for launching the arrow. This type of sighting device is also subject to significant limitations. For example, an undesirable additional step is required in that the archer must first determine the range using the range-finder and then align the target in the sighting element. That is, the archer is required to shift sighting of the target from the range-finder to the sighting element. This shifting generally is undesirable, but it is particularly undesirable in bow hunting where economy in all movement, including sighting, is important. In addition, this type of sighting device, in employing precision optics, introduces problems with optical damage, maintenance and loss of calibration, particularly so when subject to the rigors of bow hunting. This type of sighting device can be found in Saltzman U.S. Pat. No. 4,473,959 and Oligschlaeger U.S. Pat. No. 4,979,309.

Accordingly, there is a need for an improved sighting device that overcomes the limitations of conventional sighting devices.

SUMMARY OF INVENTION

The present invention fulfills the aforementioned need by providing a sighting device for use with a projectile launcher, the sighting device having a sighting element that is adjustable in height and having an adjustment mechanism for adjusting the sighting element's height to match substantially the height of a target as apparent at the sighting device in the line of sight from the user through the sighting device to the target. The sighting device further comprises a targeting mechanism that, in response to the height adjustment, automatically sets the launch angle of the projectile.

In adjusting the height of the sighting element to match the apparent height of the target, the target's distance is accounted for, according to recognized principles of physics, for use by the targeting mechanism. The targeting mechanism, preferably a mechanical assembly, displaces the position of the sighting element in a generally vertical plane so that maintenance of alignment of the target in the sighting element requires the user to adjust the elevation of the launcher and, consequently, the launch angle. In archery, for example, the archer so aligns the target by adjusting the angle at which the bow is elevated and, consequently, the angle at which the arrow is inclined.

In one embodiment, the sighting device comprises a pair of opposed rotatable disks, the disks having respective predetermined irregular peripheries. The sighting element comprises an aperture formed between selectable portions of the peripheries along the line of sight. The sighting element's height and vertical displacement are simultaneously adjusted by rotating the disks. Range finding and simultaneous targeting of the sighting device is achieved by using peripheries having predetermined irregular shapes while the mechanical linkage provides relative rotation of the disks to position selectable portions of respective peripheries in the line of sight.

In a second embodiment, the sighting element comprises a head having a predetermined irregular periphery. The adjustment mechanism comprises a lever rotatably mounted on a pivot, the head being mounted adjacent the end of the lever opposite the pivot. The sighting element's height and vertical displacement are simultaneously adjusted by rotating the lever about the pivot: the shape of the periphery provides for changes in the element's height based on rotation in the line of sight and the lever's rotation displaces the head in a substantially vertical plane.

In both embodiments, the adjustment mechanism and the targeting mechanism preferably have structure in common. In addition, the adjustment mechanism is manipulable by the user without the user changing hands, releasing grasp or otherwise substantially altering the grip on the launcher.

Accordingly, it is a principle object of the present invention to provide a novel and improved sighting device for projectile launchers.

It is another object of the present invention to provide a sighting device that is particularly adapted for use in archery, including for use with bows of various types and pull ratings, as well as with arrows of various mass and fletching.

It is a further object of the present invention to provide a sighting device that is particularly adapted for use with projectile launchers characterized by relatively low launch velocities and relatively long transit times from launch to delivery at a target.

It is yet another object of the present invention to provide a sighting device that accommodates accurate delivery of a projectile at a target based on the user's single-step manipulation of the sighting device, the manipulation being performed without the user changing hands, releasing grasp or otherwise substantially altering grip on the launcher.

It is yet a further object of the present invention to provide a sighting device which properly sets the launch angle automatically in response to adjustment of, and maintenance of alignment of a target in, a single sighting element.

It is another object of the present invention to provide a sighting device having an economy of structure, and that is compact and durable.

It is a further object of the present invention to provide a sighting device that accurately accounts for the distance between the launcher and a target by means other than a coincident-image or similar optical range-finder, and simultaneously adjusts the vertical displacement of a sighting element so that, in maintaining alignment of the target in the sighting element, the launch angle for accurate delivery of the projectile at the target is automatically set.

The foregoing and other objects, features and advantages of the invention will be more readily understood upon consideration of the following detailed description of the invention, taken in conjunction with the accompanying drawings.

DETAILED DESCRIPTION OF THE INVENTION

Figure 1:
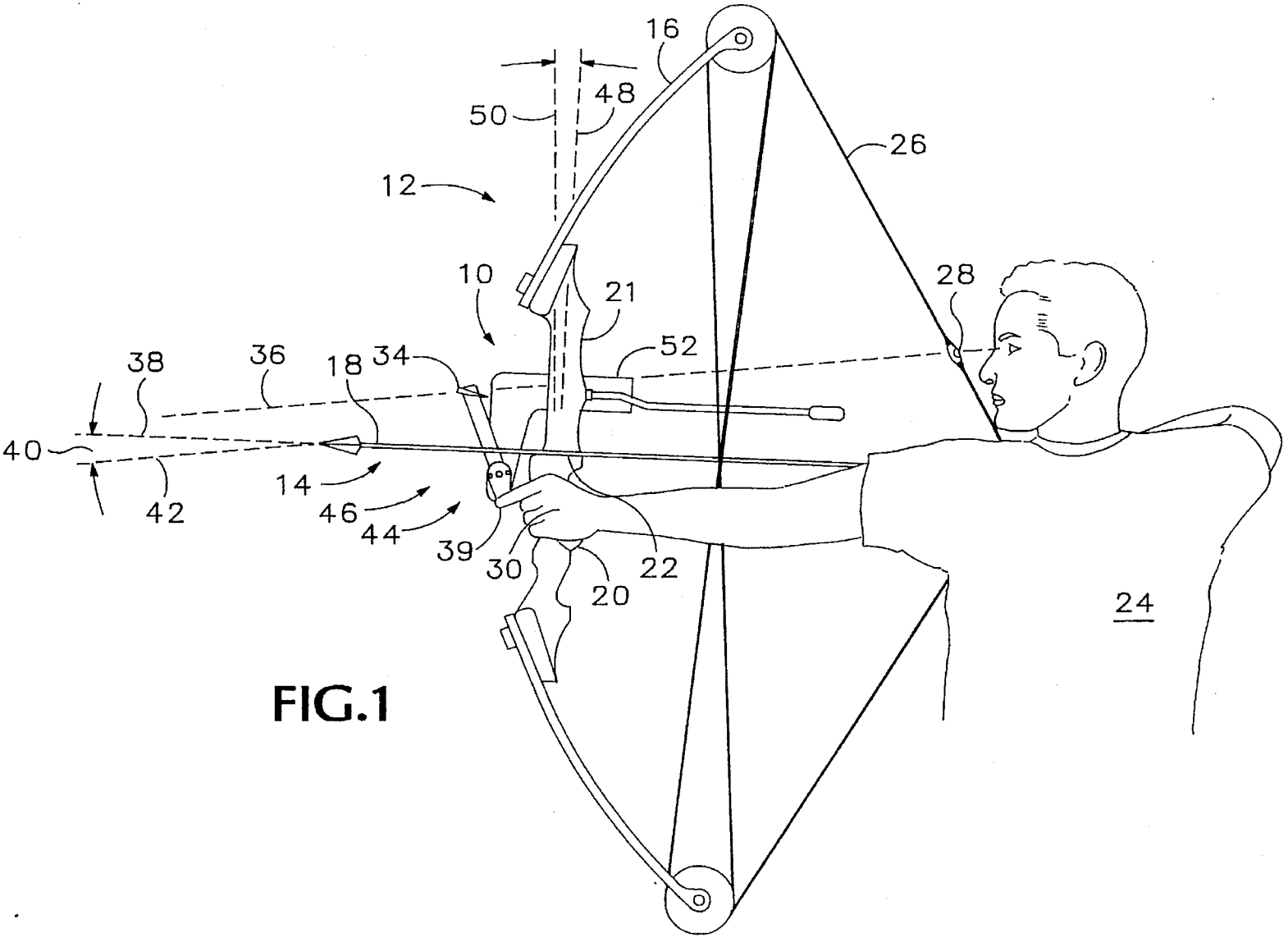
FIG. 1 is an elevational view of an embodiment of a sighting device in accordance with the present invention mounted on an archery bow, including depiction of an archer manipulating the sighting device in aiming the archery bow.

Referring to FIG. 1, one embodiment of the sighting device 10 according to the present invention is shown in use with a projectile launcher 12 and a projectile 14. In this case, the projectile launcher 12 and projectile 14 comprise a conventional archery bow 16 and an arrow 18, respectively. Although the sighting device 10 is shown used, and is described with respect to, the archery bow 16, it is to be recognized that the sighting device may be used with other types of projectile launchers 12, including other types of archery bows, without departing from the principles of the invention.

The sighting device 10 is mounted to the archery bow 16 adjacent a bow handle 20 on a bow riser 21. The arrow 18 is positioned in a guide 22 disposed on a lateral side of the handle 20. An archer 24 is depicted drawing the archery bow 16 by pulling a bow string 26 away from the handle 20. The bow string 26 has a peephole 28 disposed substantially at the archer's eye level, the peephole 28 providing a sighting reference for use in conjunction with the sighting device 10. The archery bow 16 has characteristic performance parameters, including a pull rating and, for any particular mass of the arrow 18, a launch velocity.

Referring to FIGS. 2, 3, 4 and 5, the sighting device 10 comprises a sighting element 34, an adjustment mechanism 44 and a targeting mechanism 46. The sighting element 34 has an adjustable height, as described further hereinafter. The adjustment mechanism 44 is coupled to the sighting element 34 so as to provide for adjustment of the height of the sighting element 34. The targeting mechanism 46 is responsive to the adjustment mechanism 44 so that adjustment of the height of the sighting element 34 using the adjustment mechanism 44 automatically displaces the sighting element 34. The displacement, when the bow is held upright, is in a substantially vertical plane, substantially parallel to the longitudinal axis 48 of the riser 21.

The sighting device 10 further comprises mounting structure 52 for securing the device 10 to the bow riser 21. The mounting structure 10 preferably comprises a support plate 54 and one or more fasteners 56. The fasteners 56, as shown, are nuts and bolts. However, it is to be recognized that other forms of fasteners, including screws, rivets, welds or adhesives, may be used without departing from the principles of the invention. It is also to be recognized that the sighting device 10, in particular the support plate 54, may be an integral part of the bow riser 21, for example by casting or machining as one piece, without departing from the principles of the invention.

Figure 6A:
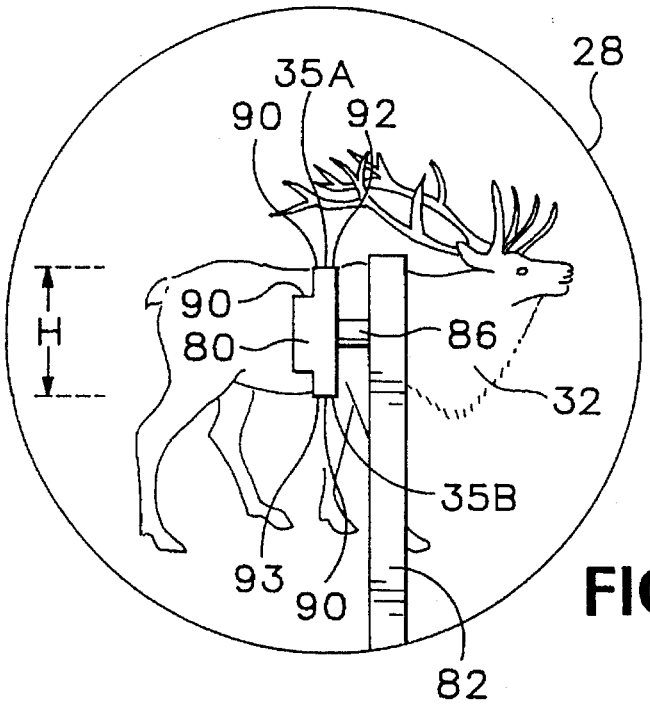
FIG. 6A is an exemplary depiction of a sighting element of the sighting device shown in FIGS. 1, 4 and 5, the height of the sighting device being matched to the apparent height of the target, as viewed through a peephole mounted in a bow string.
Figure 6B:
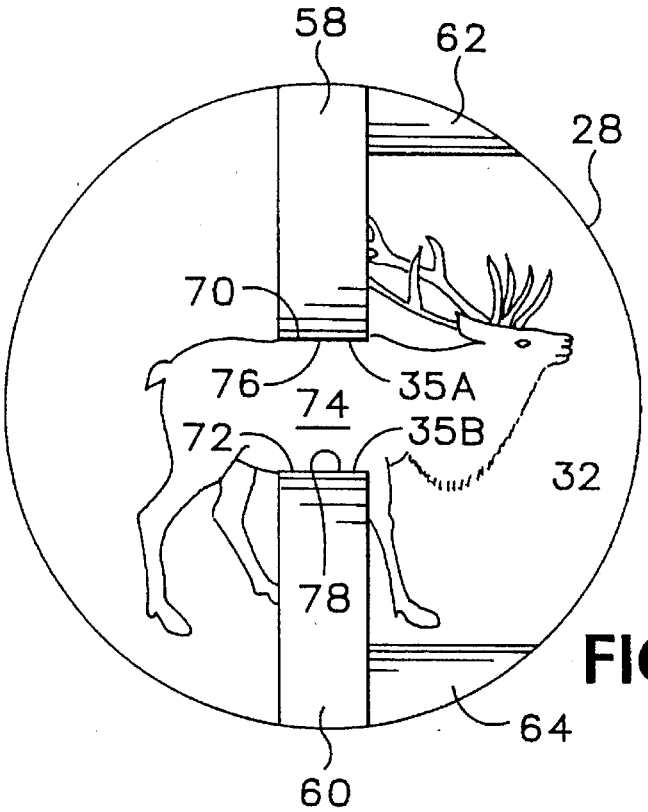
FIG. 6B is an exemplary depiction of a sighting element of the sighting device shown in FIGS. 2 and 3, the height of the sighting device being matched to the apparent height of the target, as viewed through a peephole mounted in a bow string.

The archer 24, in aiming the archery bow 16, grasps the bow 16 in a hand 30 by the handle 20. The archer 24 sights a target 32, as shown in FIGS. 6A and 6B, by aligning the target 32 in the sighting element 34, as viewed through the peephole 28 in a line of sight 36. The archer 24 adjusts the height of the sighting element 34 to match the apparent height of the target 32 at the sighting device 10. Matching heights accounts for the distance from the sighting device 10 to the target 32, according to recognized laws of physics. That is, the mathematical relationship associated with viewing remotely disposed objects provides that an object of known height positioned at a known remote distance from an observer has an apparent height at a position adjacent the observer equal to the distance from the observer to the adjacent position divided by the distance from the observer to the remote position, multiplied by the object's known height.

In FIGS. 6A and 6B, the height of the target 32 is the known height of the thoracic cavity of an elk, i.e., approximately 60 centimeters. Other game may also be sighted without departing from the principles of the invention, subject to proper coordinated implementation of the targeting mechanism 46 as described hereinafter. The height H of the sighting element 34 is adjusted to match the apparent height of the target elk. The distance from the archer's eye to the sight element 34 is substantially known. Accordingly, the mathematical relationship described above may be applied to account for the target's distance.

Referring to FIGS. 1, 6A and 6B, adjustment of the height of the sighting element 34 preferably is performed using forefinger 39 to manipulate the sighting device 10, thereby rendering adjustment as a single step, without the archer 24 changing hands, releasing grasp or otherwise substantially altering grip on the handle 20 of the archery bow 16. That adjustment is performed while maintaining alignment of the target 32 in the line of sight 36, resulting in displacement of the sighting element 34 by the targeting mechanism 46 in a substantially vertical plane. Maintaining alignment of the target 32 while displacing the sighting element 34 requires elevating the archery bow 16 that is, it requires displacing the longitudinal axis of the riser 21 from a substantially vertical axis 50. Consequently, the arrow 18 is inclined relative to a substantially horizontal axis 42 so that the arrow's launch path 38 attains a launch angle 40. The launch angle 40 determines, together with the launch velocity and other factors, the trajectory of the arrow's flight, when launched, from the archery bow 16 to the target 32.

Operation of the sighting device 10 requires use of a sighting element 34 having a first mark 35A and a second mark 35B, the distance between the marks defining a height that is adjustable in the line of sight 36. The sighting element 34 is displaceable in a substantially vertical plane in coordination with the height adjustment. As shown in FIGS. 1 through 6B, it has been found that the sighting element 34 is realizable in various forms.

Figure 2:
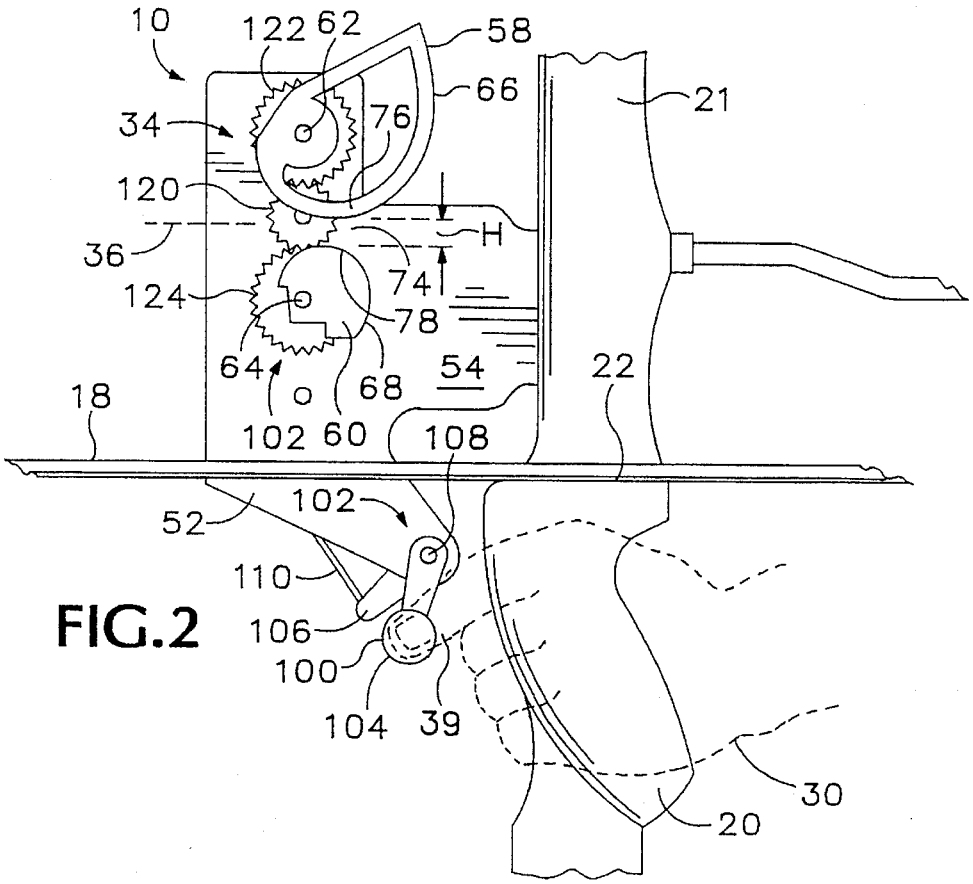
FIG. 2 is a first elevational view of one embodiment of a sighting device in accordance with the present invention, the sighting device shown mounted on a bow riser adjacent a bow handle, only a portion of the bow riser being shown, together with a portion of an arrow.
Figure 3:
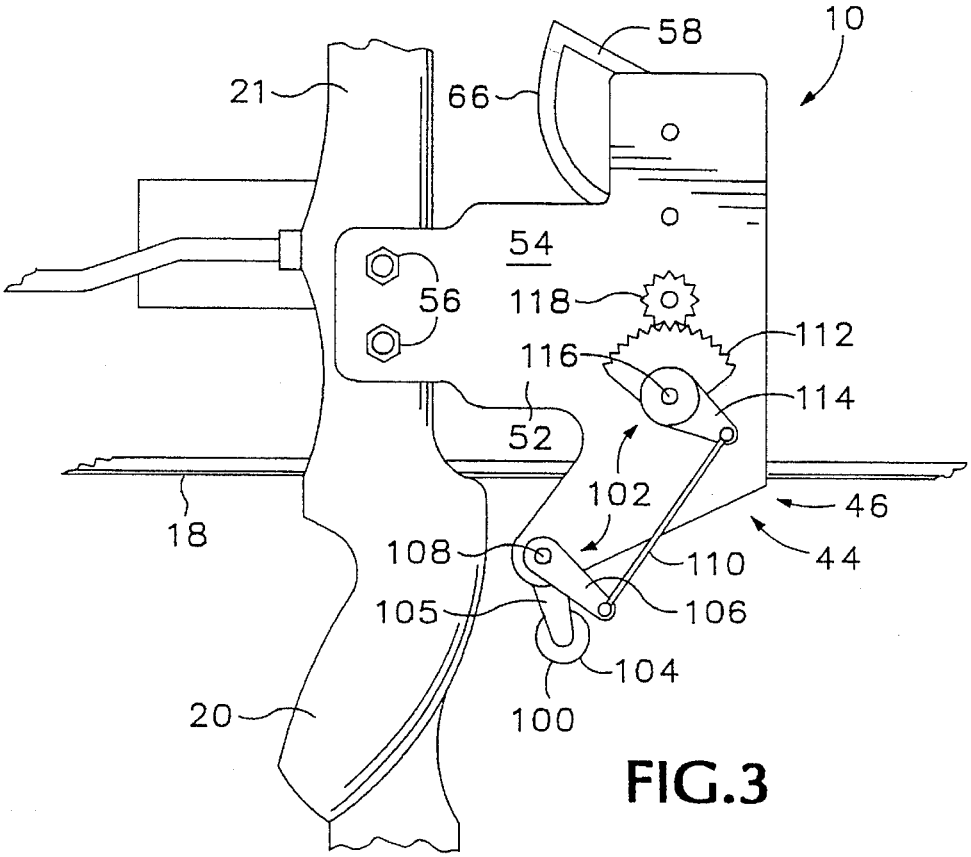
FIG. 3 is a second elevational view of the sighting device of FIG. 2, the sighting device shown mounted on a bow riser adjacent a bow handle, only a portion of the bow riser being shown, together with a portion of an arrow.

In one embodiment of the sighting device 10, as shown in FIGS. 2, 3 and 6B, the sighting element 34 comprises a first disk 58 and a second disk 60. The disks 58 and 60 are rotatably mounted opposite each other on respective axles 62 and 64. The disks 58 and 60 have respective peripheries 66 and 68, the peripheries having predetermined irregular shapes as referenced to the respective axles 62 and 64. The peripheries 66 and 68 have respective, substantially flat surfaces 70 and 72 therearound. The rotation of the disks 58 and 60 selectably positions respective portions 76 and 78 of the peripheries 66 and 68 in the line of sight 36, the portions 76 and 78 defining the marks 35A and 35B and forming an aperture 74 therebetween. The aperture 74 has an adjustable height H, the height being adjusted by rotating the disks 58 and 60. To reduce weight, the first disk 58 preferably is hollowed; it being recognized that the second disk 60 may be hollowed, or any combination of hollowed disks may be employed, without departing from the principles of the invention.

The adjustment mechanism 44 comprises an actuator 100 and a mechanical assembly 102 coupled to the actuator 100. The actuator 100 includes a button 104 and a lever arm 105. The actuator 100 is manipulable by the archer 24 as previously described. The mechanical assembly 102 includes a first lever arm 106 pivotally coupled to the lever arm 105 at pivot 108. The first lever arm 106 is pivotally coupled by a connector member 110 to a second lever arm 114. The second lever arm 114 is pivotally coupled at pivot 116 to a first gear 112. The first gear 112 meshes with a second gear 118 which is coaxial to a third gear 120 disposed on the opposite side of support plate 54. The third gear 120 meshes with a fourth gear 122 that is disposed axially on the axle 62 so as to rotate first disk 58. Similarly, third gear 120 meshes with a fifth gear 124 that is disposed axially on the axle 64 so as to rotate second disk 60. The gear ratios among the various meshed gears and the linkages among the various arms and connector members are selected so that the mechanical assembly 102 translates the manipulation of the actuator 100 to adjust the height H of the aperture 74 to match the apparent height of the target 32. It has been found for bow sights that an overall gear ratio of approximately 4:1 may be used. Although the mechanical assembly 102 as shown comprises lever arms, a member and gears as described above, it is to be recognized that the mechanical assembly may take other forms, including belts, pulleys, motors or the like, without departing from the principles of the invention, provided that the assembly translates the manipulation of the actuator 100 to adjust the height of the aperture, as described above.

In this embodiment, the targeting mechanism 46 comprises a second function of the actuator 100 and mechanical assembly 102, in cooperation with the predetermined irregular shapes of the respective peripheries 66 and 68 of the disks 58 and 60. The rotation imparted by the adjustment mechanism 44 to the disks 58 and 60 not only adjusts the height of the aperture 74, but also displaces the aperture 74 in a substantially vertical plane. The displacement results from the relative rotation of the respective peripheries 66 and 68 to pair portions thereof in the line of sight 36. It is to be recognized, however, that a targeting mechanism may be employed that has structure distinct from that of the adjustment mechanism, or of the sighting element 34, or both, without departing from the principles of the invention.

Figure 4:
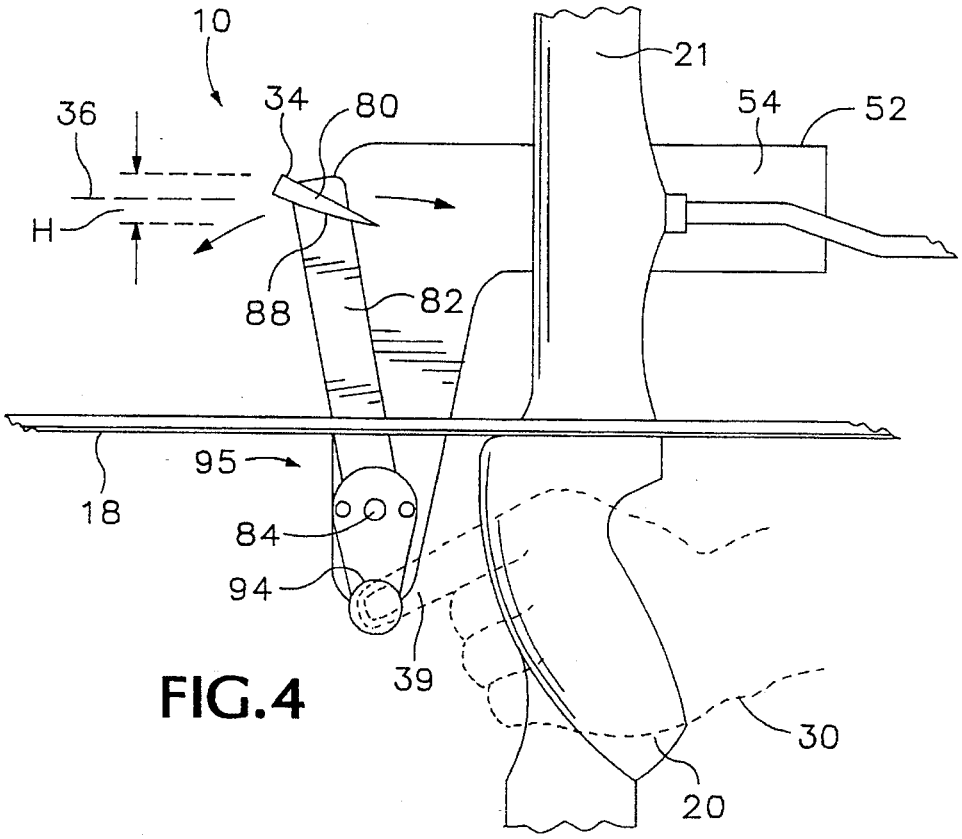
FIG. 4 is a first elevational view of another embodiment of a sighting device in accordance with the present invention, the sighting device shown mounted on a bow riser adjacent a bow handle, only a portion of he bow riser being shown, together with a portion of an arrow.
Figure 5:
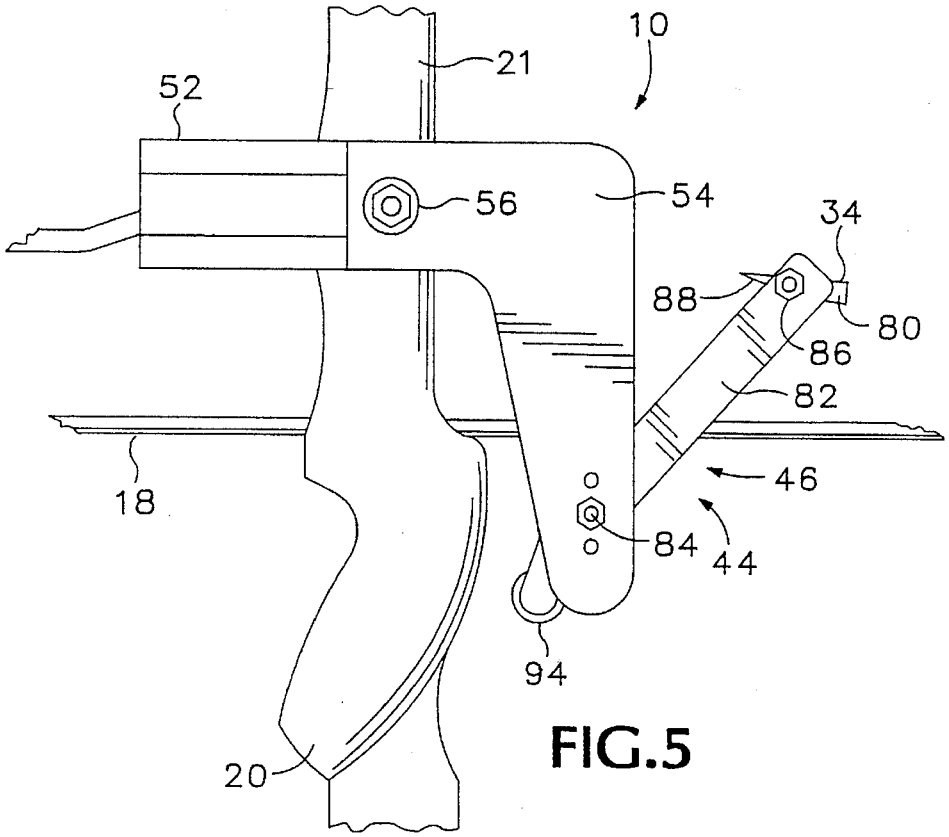
FIG. 5 is a second elevational view of the sighting device of FIG. 4, the sighting device shown mounted on a bow riser adjacent a bow handle, only a portion of the bow riser being shown, together with a portion of an arrow.

Referring to FIGS. 4, 5 and 6A, a second embodiment of the sighting device 10 is shown comprising a head 80 fixedly mounted on a lever arm 82. The head 80 is so mounted using a fastener 86. Although the fastener 86, as shown, is a nut and bolt assembly, it is to be recognized that other forms of fasteners, including screws, rivets, welds or adhesives, may be used without departing from the principles of the invention. It is also to be recognized that the head 80 may be an integral part of the lever arm 82, for example by casting or machining as one piece, without departing from the principles of the invention.

The head 80 has a periphery 88, the periphery 88 having a predetermined irregular shape. The periphery 88 has a substantially flat surface 90 therearound. The head 80, when viewed along the line of sight 36, has a top edge 92 and a bottom edge 93, the edges 92 and 93 respectfully defining the marks 35A and 35B, and the distance between the edges 92 and 93 defining the height H of the head 80. The head 80 is rotatable with the lever arm 82, the rotation altering the orientation of the periphery 88 in the line of sight 36 and, thereby, changing the head's height H by changing the distance between edges 92 and 93.

The adjustment mechanism 44 of the second embodiment comprises an actuator 94 and a mechanical assembly 95. The actuator 94 is substantially the same as actuator 100, previously described. The mechanical assembly 95 includes the lever arm 82, the lever arm 82 being pivotally coupled to the actuator at pivot 84. Although the mechanical assembly as shown comprises the lever arm, it is to be recognized that the mechanical assembly may take other forms, including gears, belts, pulleys, motors or the like, without departing from the principles of the invention.

The dimensions and shape of the lever arm 82 and the position of the pivot 84 are selected so that the mechanical assembly 95 translates the manipulation of the actuator 94 to adjust the height H of the head 80 to match the apparent height of the target 32. It has been found for bow sights that a length of from about 2.3 to about 4.6 inches may be used for the lever arm 82, the length measured from the pivot 84 to the center of the sighting element. These lengths correspond to typical target distances of between about 60 to about 150 feet and correspond inversely to arrow launch velocities from about 180 to about 250 feet per second.

In this embodiment, the targeting mechanism 46 comprises a second function of the actuator 94 and mechanical assembly 95. The rotation imparted by the adjustment mechanism 95 to the head 80 not only changes the height H of the head 80 in the line of sight 36, but also displaces the head 80 in a substantially vertical plane. It is to be recognized, however, that a targeting mechanism may be employed that has structure distinct from that of the adjustment mechanism, without departing from the principles of the invention.

It is to be recognized that, although the sighting element 34 may comprise opposed rotatable disks or a head, the sighting element 34 may take other forms without departing from the principles of the invention. For example, the sighting element may comprise a telescoping head or opposed rods forming an adjustable aperture therebetween. It is also to be recognized that the sighting element 34 may be replaceable to account for applicable sighting and targeting parameters, including mass of the arrow, size of the target, slope of terrain, targeting range, wind resistance and the like.

The shapes of the respective peripheries of the head 80 and the disks 58 and 60 are determined in accordance with recognized laws of physics, in particular the mathematical relationships associated with (i) viewing remotely disposed objects in a line of sight, as previously described, and (ii) projectile motion. The mathematical relationship associated with viewing remotely disposed objects, for any target 32 of known height for a known range of distances, determines the heights to which the head 80 and disks 58 and 60 may be adjusted and, in conjunction with the operation of the adjustment mechanism 44, the peripheral shape of these sighting elements 34. It is to be recognized that the sighting element 34 may account for targets of different heights by having more than one peripheral shapes, without departing from the principles of the invention. As shown in FIG. 6A, for example, the head 80 has two peripheries forming a stepped surface so as to sight and target both elk and, in this case, smaller game, e.g., deer, the two peripheries having similar, but scaled, shapes.

The mathematical relationship associated with projectile motion also affects the peripheral shape of the sighting element 34 in governing its vertical displacement. That is, displacement may change the element's orientation or position, or both, in the line of sight 36 and, thereby, alter the matching of the height H of the sighting element 34 to the apparent height of the target 32. The head 80, for example, is displaced through an arc having a radius determined by the dimensions of the lever arm 82, subject to variations associated with the tilting of the archery bow 16. The distance from the head 80 to the archer 24 varies with rotation about the pivot 84. Accordingly, the height of the head 80 is larger when rotated forward of the pivot 84 than it would be if its displacement was solely along a vertical line through the pivot 84. As for the disks 58 and 60, the aperture 74 is displaced in a substantially vertical line, but displacement is by rotation that also adjusts the aperture's height H, the coordination of these corrections being subject to variations introduced by tilting of the archery bow 16.

Accordingly, both physical relationships apply in determining the shape of the respective peripheries 66 and 68 of the disks 58 and 60. Thence, the peripheral shape of the sighting element 34 is ascertainable through application of these physical relationships, or by experiment, or by a combination of both.

Similarly, the coordination of the sighting element's displacement with its height adjustment is accomplished by applying physical relationships associated with projectile motion, or by experiment, or by a combination of both, in determining the structure of the adjustment mechanism 44 and the targeting mechanism 46. Factors to be considered include the range of distances over which the sighting device 10 is to be used, the launch velocity of the archery bow 16, the mass of the arrow 18, air resistance encountered by the arrow in flight, wind resistance and the like.

The terms and expressions which have been employed in the foregoing specification are used therein as terms of description and not of limitation, and there is no intention in the use of such terms and expressions of excluding equivalents of the features shown and described or portions thereof, it being recognized that the scope of the invention is defined and limited only by the claims which follow.

What is claimed is:

1. A sighting device, mounted to a projectile launcher, to facilitate accurate delivery of projectiles at a target, the target having an apparent height at the sighting device in a line of sight from the user through the sighting device to the target, the sighting device comprising:

a sighting element having a first mark and a second mark, and having an adjustable height substantially perpendicular to the line of sight, said height defined by the distance between said first and second marks;

a sighting member having an outer periphery, said outer periphery being of a predetermined irregular cross-sectional shape and having a surface therearound;

an adjustment mechanism coupled to said sighting member to selectively position said surface of said sighting member in the line of sight so that a portion of said surface of said sighting member selectively forms one of said marks of said sighting element, thereby adjusting said height of said sighting element to match substantially the apparent height of the target; and a targeting mechanism responsive to said adjustment mechanism to displace said sighting element in a substantially vertical plane.

2. The sighting device of claim 1, wherein at least one of said marks is capable of movement relative to the other of said marks in the line of sight.

3. The sighting device of claim 1, wherein said sighting element comprises an aperture in the line of sight formed by and between said first and second marks, the height of said aperture defining the height of said sighting element.

4. The sighting device of claim 1, wherein said sighting element comprises a bead in the line of sight formed by and between said first and second marks, the height of said bead defining the height of said sighting element.

5. The sighting device of claim 1, wherein said sighting member comprises a first disk having a face, said face defining said surface of said sighting member, said first disk being adjustable so as to position a selected first portion of said face in the line of sight, said selected first portion thereby defining said first mark.

6. The sighting device of claim 5, wherein said sighting element comprises an aperture in the line of sight, the height of said aperture corresponding to the height of said sighting element, said aperture being formed by said first portion and said second mark.

7. The sighting device of claim 5, wherein said first disk is mounted on an axle, and is adjusted by rotation about said axle.

8. The sighting device of claim 5, wherein said second mark is defined by structure other than said first disk.

9. The sighting device of claim 8, further comprising a second disk, said second disk having a face and being adjustable so as to position a selected first portion of said face of said second disk in the line of sight, said selected first portion of said face of said second disk defining said second mark.

10. The sighting device of claim 9, wherein said second disk is mounted on an axle, and is adjusted by rotation about said axle.

11. The sighting device of claim 5, wherein said sighting element comprises a bead in the line of sight, the height of said bead defining the height of said sighting element.

12. The sighting device of claim 11, wherein said bead is formed by and between said first portion and said second mark.

13. The sighting device of claim 12, wherein said first disk is adjustable so as to position a selected second portion of said face in the line of sight, said selected second portion thereby defining said second mark.

14. The sighting device of claim 5, wherein said first disk is adjustable so as to position a selected second portion of said face in the line of sight, said selected second portion thereby defining said second mark.

15. The sighting device of claim 14, wherein said first disk is fixedly mounted on a lever arm, and is adjusted by rotation of said lever arm.

16. The sighting device of claim 15, wherein said lever arm has a predetermined length of from about 2.3 to about 4.6 inches.

17. The sighting device of claim 1, wherein said surface of said sighting member is stepped lateral to the line of sight so that said height of said sighting element is capable of matching the apparent height of a plurality of targets.

18. The sighting device of claim 1, wherein said adjustment mechanism comprises an actuator and a first mechanical assembly, said actuator being manipulable, said first mechanical assembly being coupled to said actuator and to said sighting member so that said first mechanical assembly translates manipulation of said actuator to adjust said height of said sighting element according to a predetermined relationship.

19. The sighting device of claim 18, wherein said first mechanical assembly comprises a first lever coupled to said actuator, a first gear coupled to said lever, a second gear coupled to said first gear, a third gear coaxial with said second gear, and a fourth gear coupled to said third gear and engaging said sighting member.

20. The sighting device of claim 18, wherein said first mechanical assembly comprises a lever rotatably mounted on a pivot, said lever having predetermined length, said sighting member being fixedly mounted to said lever arm.

21. The sighting device of claim 18, wherein at least one of said marks is coupled to said first mechanical assembly so as to be moveable relative to the other of said marks.

22. The sighting device of claim 1, wherein said targeting mechanism comprises a mechanical assembly, said mechanical assembly being coupled to said adjustment mechanism and to said sighting element, said mechanical assembly translating adjustment of said adjustment mechanism so as to displace said sighting element in a substantially vertical plane according to a predetermined relationship.

* * * * *